US010829275B2

(12) United States Patent
Owusu

(10) Patent No.: US 10,829,275 B2
(45) Date of Patent: Nov. 10, 2020

(54) FITNESS BOTTLE

(71) Applicant: Jaxamo Ltd., Bedfordshire (GB)

(72) Inventor: Stephen Owusu, Newcastle, WA (US)

(73) Assignee: JAXAMO LTD (GB)

( * ) Notice: Subject to any disclaimer, the term of this patent is extended or adjusted under 35 U.S.C. 154(b) by 0 days.

(21) Appl. No.: 16/207,700

(22) Filed: Dec. 3, 2018

(65) Prior Publication Data

US 2020/0172304 A1 Jun. 4, 2020

(51) Int. Cl.
*B65D 47/08* (2006.01)
*A45F 3/18* (2006.01)
*A47G 19/22* (2006.01)

(52) U.S. Cl.
CPC ..... *B65D 47/0861* (2013.01); *A45F 3/18* (2013.01); *A47G 19/2266* (2013.01)

(58) Field of Classification Search
CPC .... B65D 47/0861; A45F 3/18; A47G 19/2266
USPC ..... 215/295
See application file for complete search history.

(56) References Cited

U.S. PATENT DOCUMENTS 4,009,794 A 3/1977 Zapp
4,303,173 A 12/1981 Nergard
5,203,468 A * 4/1993 Hsu ..... A47G 19/2272 220/254.3
5,484,080 A * 1/1996 Blasnik ..... B65D 77/283 220/708
5,582,316 A 12/1996 Masayoshi et al.
5,746,338 A 5/1998 Takahashi et al.
6,116,476 A * 9/2000 Huang ..... B65D 47/249 222/506
7,546,933 B2 * 6/2009 Pinelli ..... A47G 19/2272 220/715
7,766,057 B2 * 8/2010 Windmiller ..... B65D 1/06 141/113
7,997,442 B2 * 8/2011 Pinelli ..... A47G 19/2272 220/715
8,182,683 B1 * 5/2012 Allen ..... C02F 1/003 210/244
8,215,344 B2 * 7/2012 Windmiller ..... B65D 1/06 141/113
8,403,173 B2 3/2013 Wahl et al.
8,464,895 B2 6/2013 Gilbert et al.
8,550,269 B2 * 10/2013 Lane ..... B65D 51/242 215/229

(Continued)

FOREIGN PATENT DOCUMENTS

EP 2540198 A1 1/2013
EP 2567909 A1 3/2013

(Continued)

OTHER PUBLICATIONS

International Search Report and Written Opinion for International Application No. PCT/EP2019/083031, dated Feb. 20, 2020, 14 pages.

*Primary Examiner* — Ernesto A Grano
(74) *Attorney, Agent, or Firm* — RatnerPrestia

(57) ABSTRACT

A fitness bottle that can contain a liquid is disclosed. The bottle is openable and closeable by one hand of a user during exercise. The bottle includes an open/close mechanism whereby a push of a button serves to open the bottle if it is closed, or to close the bottle if it is open.

18 Claims, 15 Drawing Sheets

(56) References Cited

U.S. PATENT DOCUMENTS

| | | | | |
|---|---|---|---|---|
| 8,689,989 | B2 * | 4/2014 | Lane | A45F 3/16 215/237 |
| D716,657 | S | 11/2014 | Caneer | |
| 8,907,796 | B2 | 12/2014 | Sweeney et al. | |
| 8,960,490 | B2 | 2/2015 | Carlile et al. | |
| D728,313 | S | 5/2015 | Bo | |
| 9,079,205 | B2 | 7/2015 | Hoskins | |
| D748,943 | S | 2/2016 | Miller et al. | |
| D768,491 | S | 10/2016 | Sorensen et al. | |
| D769,063 | S | 10/2016 | Sweeney | |
| 9,808,101 | B2 * | 11/2017 | Chiou | B65D 43/02 |
| 9,908,687 | B2 * | 3/2018 | Chiou | A47G 19/2272 |
| D818,768 | S | 5/2018 | Joseph et al. | |
| D818,774 | S | 5/2018 | Stover | |
| 10,023,366 | B2 * | 7/2018 | Gilbert | B65D 43/26 |
| 10,421,587 | B2 * | 9/2019 | Gilbert | B65D 43/26 |
| 2006/0073294 | A1 * | 4/2006 | Hutchinson | B29C 70/66 428/35.7 |
| 2007/0210093 | A1 * | 9/2007 | Pinelli | B65D 51/18 220/715 |
| 2008/0302711 | A1 * | 12/2008 | Windmiller | B65D 1/06 210/137 |
| 2011/0155750 | A1 * | 6/2011 | Bernstein | A45F 3/16 220/714 |
| 2012/0187075 | A1 * | 7/2012 | El-Saden | B65D 47/066 215/389 |
| 2012/0312832 | A1 * | 12/2012 | Lane | B65D 51/242 220/833 |
| 2013/0140309 | A1 * | 6/2013 | George | B65D 47/248 220/254.1 |
| 2013/0319966 | A1 * | 12/2013 | Lane | B65D 43/26 215/237 |
| 2014/0048511 | A1 * | 2/2014 | El-Saden | A45F 3/16 215/389 |
| 2015/0060448 | A1 * | 3/2015 | Coon | A45F 3/18 220/254.1 |
| 2015/0122688 | A1 | 5/2015 | Dias et al. | |
| 2015/0136772 | A1 | 5/2015 | Sorensen et al. | |
| 2015/0284163 | A1 * | 10/2015 | Manwani | B67D 3/0067 222/105 |
| 2017/0144809 | A1 * | 5/2017 | Sorensen | B65D 43/16 |
| 2017/0188731 | A1 | 7/2017 | Schuller et al. | |
| 2017/0233153 | A1 | 8/2017 | Peters | |
| 2017/0253394 | A1 * | 9/2017 | Fogarty | B65D 47/065 |
| 2018/0127165 | A1 * | 5/2018 | Smaldone | B65D 45/025 |
| 2018/0208366 | A1 * | 7/2018 | Fang | A45F 3/18 |
| 2019/0177049 | A1 * | 6/2019 | Farsai | B65D 47/2018 |
| 2019/0282979 | A1 * | 9/2019 | Noall | B65D 51/2821 |
| 2019/0344934 | A1 * | 11/2019 | Faerber | B65D 53/04 |

FOREIGN PATENT DOCUMENTS

| | | | |
|---|---|---|---|
| FR | 2309420 | A1 | 11/1976 |
| GB | 2288529 | A | 10/1995 |
| WO | 2012103364 | A1 | 8/2012 |

* cited by examiner

FITNESS BOTTLE

FIELD OF THE INVENTION

The invention relates to a fitness bottle intended to hold liquids to be ingested during exercise. The bottle can be opened or closed easily during exercise and can be opened and closed with one hand.

BACKGROUND OF THE INVENTION

When engaging in strenuous physical activity, such as running, bicycle riding, hiking and the like, for long periods of time, it is important that the exerciser maintain adequate hydration. Therefore, it is usual practice for the exerciser to carry with them a bottle of water or other liquid, or if using a treadmill or stationary bicycle, to have the bottle nearby, in order to take frequent sips of liquid as necessary. However, it also is advantageous for the bottle to remain sealed when not in use, so that the liquid does not spill out. Consequently many such bottles are equipped with a removable cover, so that the exerciser can open the bottle, take a sip and then reclose the bottle.

Such opening and closing action generally requires the use of both hands or multiple steps using a single hand and therefore taking a sip of liquid during exercise interrupts the rhythm of exercise such as running, or can even be a dangerous action if the exerciser is riding a bicycle on a busy road for instance. Therefore, there is a need for a bottle that can be conveniently grabbed, opened to take a quick sip and reclosed by using one hand to effect opening or closing of the bottle.

SUMMARY OF THE INVENTION

According to one aspect of the invention, a fitness bottle is provided that is operable by one hand of a user during exercise. The fitness bottle includes a body configured to contain a liquid. The fitness bottle also includes a closure assembly removably coupled to the body, the closure assembly having an open configuration allowing the liquid to flow from the body through the closure assembly and a closed configuration restricting flow of the liquid from the body through the closure assembly, the closure assembly having a spout defining an opening through which the liquid can flow when the closure assembly is in the open configuration, and the closure assembly having a closure configured to seal the opening of the spout when the closure assembly is in the closed configuration and to unseal the opening of the spout when the closure is in the open configuration, wherein the position of the closure relative to the spout changes upon movement of the closure assembly from the open configuration to the closed configuration. The fitness bottle also includes an actuator associated with the body or the closure assembly and positioned for opening actuation by the user to move the closure assembly from the closed configuration to the open configuration and for closing actuation by the user to move the closure assembly from the open configuration to the closed configuration. The fitness bottle also includes a linkage coupled to the actuator, the linkage being configured to translate the opening actuation of the actuator to move the closure assembly from the closed configuration to the open configuration to unseal the opening of the spout of the closure assembly by the closure of the closure assembly, and the linkage also being configured to translate the closing actuation of the actuator to move the closure assembly from the open configuration to the closed configuration to seal the opening of the spout of the closure assembly by the closure of the closure assembly.

The actuator and the linkage can be configured such that the opening actuation of the actuator and the closing actuation of the actuator are both achieved by depressing the actuator. The actuator and the linkage can also be configured such that the opening actuation of the actuator and the closing actuation of the actuator provide push-push actuation to open and close the closure assembly, respectively. The fitness bottle can also include a damper positioned (1) to retard motion of the closure relative to the spout to unseal the opening of the spout, (2) to retard motion of the closure relative to the spout to seal the opening of the spout, or (3) to retard motion of the closure relative to the spout to unseal the opening of the spout and to retard motion of the closure relative to the spout to seal the opening of the spout. The linkage of the fitness bottle can include a lever positioned to convert translation of the linkage to motion of the closure. The linkage can also include a slider that contacts the lever. The body can define an indentation on an exterior side surface thereof, wherein the indentation is configured and positioned to at least partially receive the closure assembly. The closure assembly can include a tongue-shaped extension depending downward therefrom, wherein the extension carries the actuator, and wherein a depth of the indentation corresponds to a thickness of the tongue-shaped extension. The indentation and the tongue-shaped extension can extend at least partially along the length of the body such that a bottom end of the extension and the actuator are spaced below the top of the body and toward a midsection of the body. The closure can include a sealing surface positioned to form a leak-proof or leak-resistant seal of the opening of the spout when the closure assembly is in the closed configuration. The actuator can define a cam surface oriented to operate the linkage upon the opening actuation and the closing actuation. The actuator can be located adjacent a side wall of the body. The actuator can also be located below the spout of the closure assembly. The opening actuation and the closing actuation of the actuator can include movement in an inward direction toward a center of the body, wherein the cam surface is configured and arranged to convert the movement of the actuator in an inward direction to a movement of the linkage toward a top of the fitness bottle. The movement of the actuator in an inward direction can be a horizontal movement. The movement of the linkage toward the top of the fitness bottle can be a vertical movement. The closure of the closure assembly can be mounted for movement relative to the spout of the closure assembly, and the spout of the closure assembly can be stationary. The closure of the closure assembly can include a hood.

According to another aspect of the invention, a method of operating a fitness bottle is provided. The method includes the steps of (a) at least partially filling a body of the fitness bottle with a liquid; (b) coupling a closure assembly of the fitness bottle to the body of the fitness bottle, wherein step a) and step b) can be performed in any order; and (c) actuating an actuator associated with the body or the closure assembly, the actuating including opening actuation to move the closure assembly from a closed configuration to an open configuration and closing actuation to move the closure from the open configuration to the closed configuration. The opening actuation includes translating a linkage extending between the actuator and a closure of the closure assembly to change the position of the closure relative to a spout of the closure assembly to unseal an opening of the spout of the closure assembly by the closure of the closure assembly, thereby moving the closure assembly from the closed configuration to the open configuration. The closing actuation includes translating the linkage to change the position of the closure relative to the spout to seal the opening of the spout of the closure assembly with the closure of the closure assembly, thereby moving the closure assembly from the open configuration to the closed configuration.

The actuating step can include depressing the actuator for the opening actuation of the actuator and depressing the actuator for the closing actuation of the actuator. The actuating step can also include depressing the actuator toward a center of the body of the fitness bottle for the opening actuation of the actuator and depressing the actuator toward the center of the body of the fitness bottle for the closing actuation of the actuator. The actuating step can include push-push actuation to open and close the closure assembly, respectively.

According to another aspect of the invention, a method of assembling a fitness bottle is provided. The method includes the steps of removably coupling a closure assembly to a body configured to contain a liquid, the closure assembly having an open configuration allowing the liquid to flow from the body through the closure assembly and a closed configuration restricting flow of the liquid from the body through the closure assembly, the closure assembly having a spout defining an opening through which the liquid can flow when the closure assembly is in the open configuration; positioning a closure for relative movement with respect to the spout such that the closure is positionable to seal an opening defined by the spout when the closure assembly is in the closed configuration; coupling an actuator to the body or the closure assembly for opening actuation by the user to move the closure assembly from the closed configuration to the open configuration and for closing actuation by the user to move the closure assembly from the open configuration to the closed configuration; and extending a linkage between the actuator and the closure of the closure assembly to translate the opening actuation of the actuator to change the position of the closure relative to the spout to unseal the opening of the spout of the closure assembly by the closure of the closure assembly, thereby moving the closure assembly from the closed configuration to the open configuration, and to translate the closing actuation of the actuator to change the position of the closure relative to the spout to seal the spout of the closure assembly with the closure of the closure assembly, thereby moving the closure assembly from the open configuration to the closed configuration.

The positioning step can include positioning a lever to effect movement of the closure. The coupling step can include positioning the actuator adjacent a side wall of the body. The coupling step can also include positioning the actuator at a location below the closure assembly. The extending step can include extending the linkage vertically between the actuator and the closure of the closure assembly whereby a horizontal opening actuation of the actuator is translated to a vertical movement of the linkage which results in the movement of the closure relative to the spout to unseal the opening of the spout of the closure assembly by the closure of the closure assembly, thereby moving the closure assembly from the closed configuration to the open configuration, and whereby the horizontal closing actuation of the actuator is translated to a vertical movement of the linkage which results in movement of the closure relative to the spout to seal the opening of the spout of the closure assembly with the closure of the closure assembly, thereby moving the closure assembly from the open configuration to the closed configuration.

According to another aspect of the invention, a closure assembly operable by one hand of a user is provided, the closure assembly being configured for coupling to a body adapted to contain liquid to form a fitness bottle for use during exercise. The closure assembly has an open configuration configured to allow liquid to flow through the closure assembly and a closed configuration configured to restrict flow of liquid through the closure assembly. The closure assembly also has a spout defining an opening through which liquid can flow when the closure assembly is in the open configuration; a closure configured to seal the opening of the spout when the closure assembly is in the closed configuration and to unseal the opening of the spout when the closure is in the open configuration, wherein the position of the closure relative to the spout changes upon movement of the closure assembly from the open configuration to the closed configuration; an actuator associated with the closure assembly and positioned for opening actuation by the user to move the closure assembly from the closed configuration to the open configuration and for closing actuation by the user to move the closure assembly from the open configuration to the closed configuration; and a linkage extending between the actuator and the closure assembly, the linkage being configured to translate the opening actuation of the actuator to move the closure assembly from the closed configuration to the open configuration to unseal the opening of the spout of the closure assembly by the closure of the closure assembly, and the linkage also being configured to translate the closing actuation of the actuator to move the closure assembly from the open configuration to the closed configuration to seal the opening of the spout of the closure assembly by the closure of the closure assembly.

The closure assembly can also include a tongue-shaped extension depending downward therefrom, wherein the extension carries the actuator. The tongue-shaped extension can be configured and arranged such that the actuator of the closure assembly is spaced from the closure of the closure assembly such that, when coupled to the body, the actuator is spaced below the top of the body.

BRIEF DESCRIPTION OF THE DRAWINGS

The foregoing summary and the following description will be better appreciated and understood in conjunction with the non-limiting examples illustrated in the attached drawing figures, of which.

DETAILED DESCRIPTION OF THE INVENTION

Figure 1:
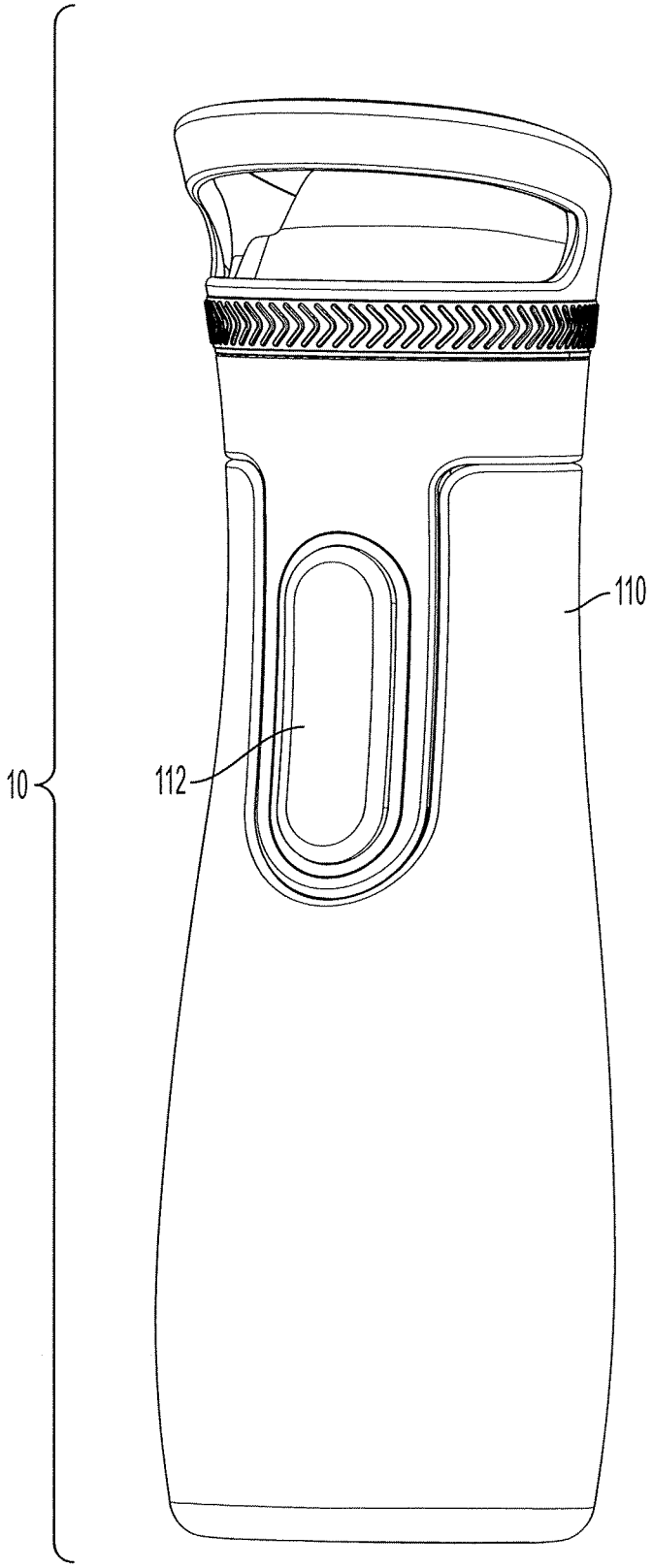
FIG. 1 is a perspective view of a fitness bottle in accordance with a first exemplary embodiment of the invention.

Although the invention is illustrated and described herein with reference to specific embodiments, the invention is not intended to be limited to the details shown. Rather, various modifications may be made in the details within the scope and range of equivalents of the claims and without departing from the invention.

The invention will be described with reference to the attached drawing figures. It should be understood that the reference numerals are consistent through the various views shown in the drawing figures, such that the same parts always are referred to with the same reference number in all of the various views. It should also be understood that directions, e.g. "horizontal" and "vertical," refer to the fitness bottle when it is standing upright. Therefore, "horizontal" refers to a direction that is generally parallel to the bottom of the fitness bottle. The term "vertical" thus refers to a direction that is generally normal to the bottom of the fitness bottle.

As described herein, a bottle and its opening mechanism are disclosed. The bottle comprises an opening and closing mechanism that is operable by a single push of a button that serves to open the bottle if it is closed and to close the bottle if it is open. Preferably, the opening and closing mechanism is operable using one finger on one hand, the finger being on the same hand that is holding the bottle.

Referring generally to the figures, reference is made to selected non-limiting embodiments of features of the invention. One aspect of the invention provides a fitness bottle 10, 20 that is operable by one hand of a user during exercise. The fitness bottle includes a body 110, 210 configured to contain a liquid. The fitness bottle 10, 20 also includes a closure assembly (including, for example, at least some or all of the components of fitness bottle 10, 20 other than the body 110, 210) removably coupled to the body 110, 210.

The closure assembly has an open configuration allowing the liquid to flow from the body through the closure assembly and a closed configuration restricting flow of the liquid from the body through the closure assembly. The closure assembly also has a spout 114, 214 defining an opening through which the liquid can flow when the closure assembly is in the open configuration. The closure assembly also has a closure 116, 216 configured to seal the opening of the spout 114, 214 when the closure assembly is in the closed configuration and to unseal the opening of the spout 114, 214 when the closure 116, 216 is in the open configuration.

The position of the closure 116, 216 relative to the spout 114, 214 changes upon movement of the closure assembly from the open configuration to the closed configuration (either the position of closure 116, 216 is movable relative to a stationary spout 114, 214, the position of spout 114, 214 is movable relative to a stationary closure 116, 216, or the positions of the closure 116, 216 and the spout 114, 214 are both movable relative to one another).

The fitness bottle also includes an actuator 112, 212 associated with the body 110, 210 or the closure assembly and positioned for opening actuation by the user to move the closure assembly from the closed configuration to the open configuration and for closing actuation by the user to move the closure assembly from the open configuration to the closed configuration.

The fitness bottle also includes a linkage 134, 234 coupled to the actuator 112, 212, the linkage 134, 234 being configured to translate the opening actuation of the actuator 112, 212 to move the closure assembly from the closed configuration to the open configuration to unseal the opening of the spout 114, 214 of the closure assembly by the closure 116, 216 of the closure assembly, and the linkage 134, 234 also being configured to translate the closing actuation of the actuator 112, 212 to move the closure assembly from the open configuration to the closed configuration to seal the opening of the spout 114, 214 of the closure assembly by the closure 116, 216 of the closure assembly.

The actuator and the linkage can be configured such that the opening actuation of the actuator and the closing actuation of the actuator are both achieved by depressing the actuator. The actuator and the linkage can also be configured such that the opening actuation of the actuator and the closing actuation of the actuator provide push-push actuation to open and close the closure assembly, respectively.

The fitness bottle can also include an optional damper 138 positioned (1) to retard motion of the closure relative to the spout to unseal the opening of the spout, (2) to retard motion of the closure relative to the spout to seal the opening of the spout, or (3) to retard motion of the closure relative to the spout to unseal the opening of the spout and to retard motion of the closure relative to the spout to seal the opening of the spout.

The linkage of the fitness bottle can include a lever 142, 242 positioned to convert translation of the linkage to motion of the closure. The linkage can also include a slider that contacts the lever.

The body can define an indentation 324 on an exterior side surface thereof, wherein the indentation 324 is configured and positioned to at least partially receive the closure assembly. The closure assembly can include a tongue-shaped extension depending downward therefrom, wherein the extension carries the actuator, and wherein a depth of the indentation corresponds to a thickness of the tongue-shaped extension. The indentation and the tongue-shaped extension can extend at least partially along the length of the body such that a bottom end of the extension and the actuator are spaced below the top of the body and toward a midsection of the body.

The closure can include a sealing surface 158, 258 positioned to form a leak-proof or leak-resistant seal of the opening of the spout when the closure assembly is in the closed configuration. The actuator can define a cam surface 172, 272 oriented to operate the linkage upon the opening actuation and the closing actuation. The actuator can be located adjacent a side wall of the body. The actuator can also be located below the spout of the closure assembly.

The opening actuation and the closing actuation of the actuator can include movement in an inward direction toward a center of the body, wherein the cam surface is configured and arranged to convert the movement of the actuator in an inward direction to a movement of the linkage toward a top of the fitness bottle. The movement of the actuator in an inward direction can be a horizontal movement. The movement of the linkage toward the top of the fitness bottle can be a vertical movement. The closure of the closure assembly can be mounted for movement relative to the spout of the closure assembly, and the spout of the closure assembly can be stationary. The closure of the closure assembly can include a hood.

According to another aspect of the invention, a closure assembly operable by one hand of a user is provided, the closure assembly being configured for coupling to a body adapted to contain liquid to form a fitness bottle for use during exercise. In other words, the closure assembly may be provided separately from the body such as for subsequent retrofit or assembly or exchange to form a fitness bottle by coupling the closure assembly to a body component. Also, the body component may be provided separately from the closure assembly such as for subsequent retrofit or assembly or exchange to form a fitness bottle by coupling the body component to a closure assembly.

Referring now to specific figures, FIG. 1 shows a perspective view of a first embodiment of a fitness bottle or cup 10. The fitness bottle 10 comprises a bottle body 110 which is constructed and arranged to contain liquid. Also shown in FIG. 1 is a button actuator or button switch top 112 that is arranged to be pushable by one hand or preferably one finger of a person holding the fitness bottle 10. As will be shown in detail in the following description, the button actuator 112 is linked to a "push-push" mechanism whereby a single push depressing the button actuator will open the fitness bottle 10 if it is closed, or the single push to depress the button actuator 112 will close the fitness bottle 10 if it is open. The action of depressing the button actuator is thus translated via a linkage that serves to open or close the fitness bottle.

The button actuator 112 is advantageously located on a side of the bottle body 110 and at a point vertically below the top of the fitness bottle 10, preferably near or toward the center of gravity of the fitness bottle. Therefore, a person can comfortably hold the fitness bottle 10, press the button actuator 112 and conveniently tip the fitness bottle 10 to take a sip without having to adjust the location of their grip on the bottle body 110. This is particularly important as the fitness bottle 10 gets emptier and its center of gravity shifts toward the bottom of the fitness bottle 10.

Figure 2B:
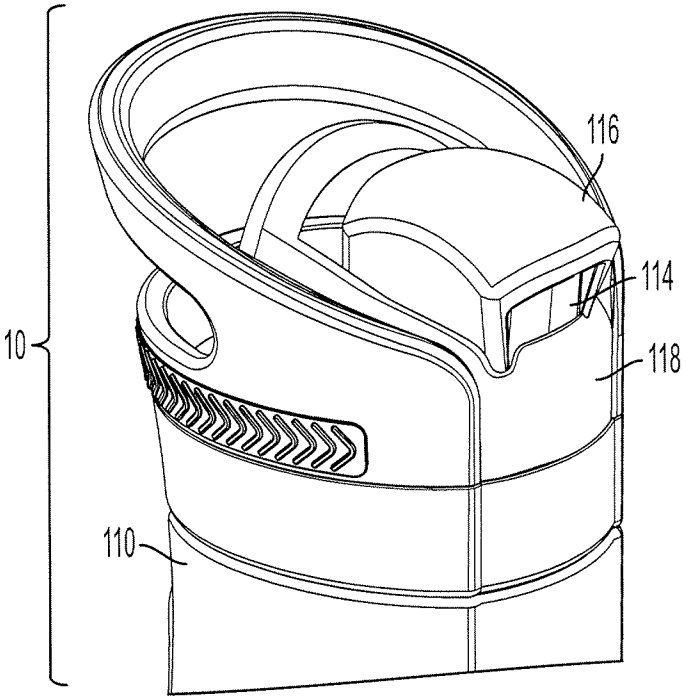
FIGS. 2A and 2B are perspective views of the first embodiment of the fitness bottle showing the bottle in the open and closed positions, respectively.
Figure 2A:
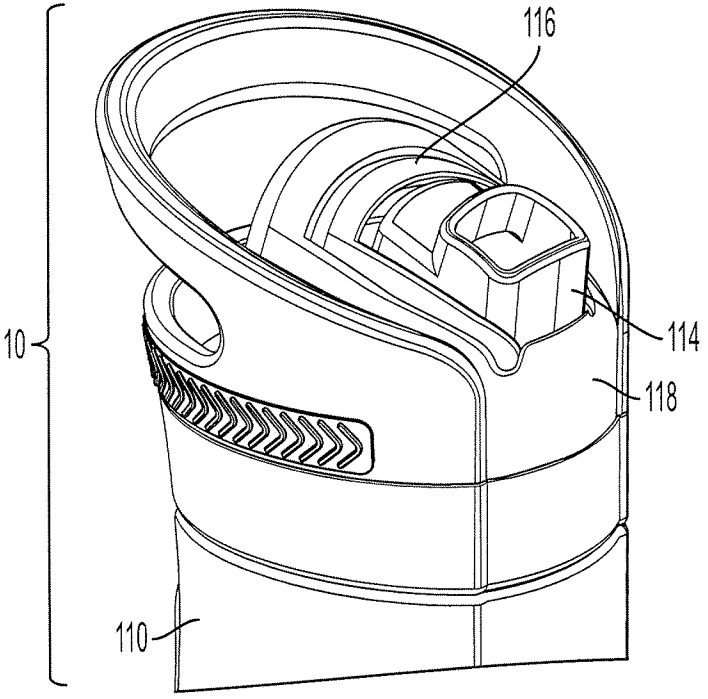

FIGS. 2A and 2B show top perspective views of the fitness bottle 10 in the open position and the closed position, respectively. Shown in FIG. 2A, in the open position, is a stationary spout or stationary top 114. Liquid contained in the bottle body 110 can flow freely through the spout 114 when the fitness bottle 10 is open. FIG. 2B shows the fitness bottle 10 in the closed position, wherein a moveable closure in the form of a hood 116 has moved from a closure housing 118 to seal the stationary spout 114. Turning again to FIG. 2A, the hood 116 is visible in the open position where the hood 116 has moved away from the spout 114 and into the closure housing 118. A person having skill in the art can appreciate that while in this embodiment the spout 114 is stationary and the closure in the form of the hood 116 is moveable, these two pieces need only move with respect to each other to effect opening or closing of the fitness bottle 10. Thus, in alternative embodiments, the spout 114 could move and the hood 116 could be stationary, or both the spout 114 and the hood 116 could be moveable. In all such embodiments, the position of the spout is changed relative to the position of the hood, and the position of the hood is changed relative to the position of the spout.

Figure 3:
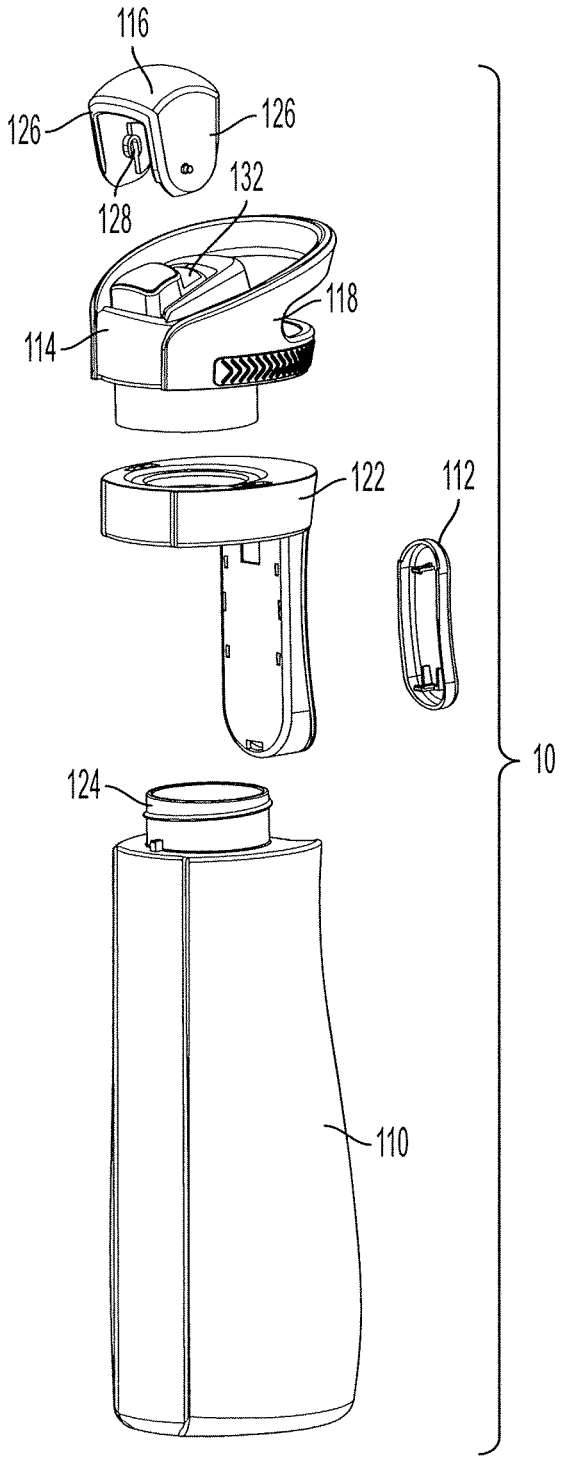
FIG. 3 is an exploded view showing some of the components of the first embodiment of the fitness bottle.

FIG. 3 is an exploded view of the fitness bottle 10. As can be seen in FIG. 3, the closure housing 118 is constructed to fit into a collar 122 and to also removably couple with the bottle body 110 in order to provide a leak-proof seal to the bottle body 110. As shown in FIG. 3, this leak-proof seal can be effected by attaching the closure housing 118 to a neck 124 on the bottle body 110. A leak-proof seal can comprise any means such as are known in the art, for instance via a snap-tight seal or a screw-on seal or a quarter-turn seal.

Also shown in FIG. 3 is the hood 116. The hood 116 has a rounded top surface and two legs 126 depending therefrom. Each leg 126 has a pivot projection 128. Only one pivot projection 128 is visible in FIG. 3. As shown in FIG. 3, the pivot projections 128 extend from the interior surface of each hood leg 126 and are constructed and arranged to fit into matching pivot points 144 on a lever or frame 142 (shown in FIG. 4). It should be appreciated that these pivot projections 128 can extend from either the interior or exterior of the legs 126. The hood 116 and legs 126 are constructed and arranged to fit into a hood aperture 132 in the closure housing 118. Note that the hood aperture 132 extends about the spout 114. The hood aperture 132 is optional.

Figure 4A:
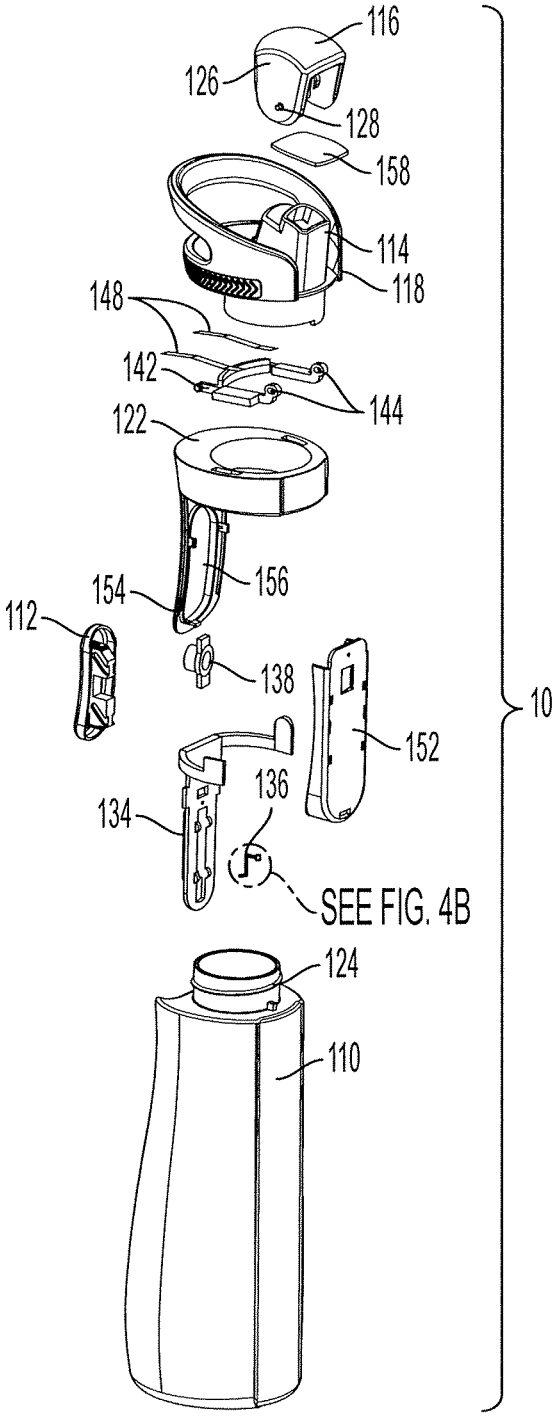
FIG. 4 is an exploded view showing additional components of the first embodiment of the fitness bottle.
Figure 4B:
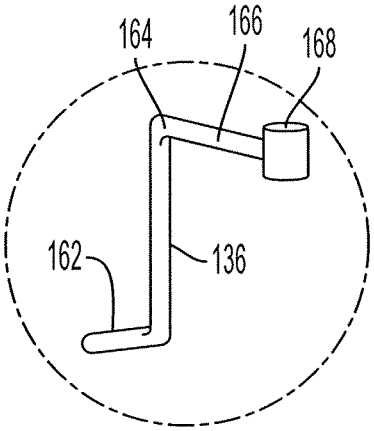

Turn next to FIG. 4, which shows an exploded view of additional components of the fitness bottle 10. These components will be listed briefly here and the details of the components and operation of the "push-push" mechanism will be described in more detail in subsequent drawing figures.

Shown in FIG. 4 in addition to the components listed previously, is a slide linkage or slider 134. As will be shown in more detail in subsequent figures, the slide linkage 134 is constructed and arranged so as to translate movement of the button 112 (also referred to herein as one embodiment of an actuator) into movement of the hood 116 from the open position to the closed position or vice-versa. Also shown is a push-push follower 136, a damper 138, and the lever 142. The lever 142 comprises the two pivot points 144 (previously mentioned). These pivot points 144 are arranged so as to mate with the pivots 128 on the hood legs 126 that are mounted on hood 116, thereby allowing the hood 116 to move pivotally from the open to the closed position or vice-versa. As will be shown in detail in further figures, the lever 142 is arranged to contact the slide linkage 134, such that the slide linkage 134 is able to rotate the lever 142, thereby effecting pivoting motion of the hood 116. Shown also are two springs 148, which are designed to maintain contact with the lever 142 and urge the lever 142 to maintain contact with the slide linkage 134.

Shown also in FIG. 4 is a collar back cover or main case 152 which is constructed to snap onto or otherwise attach fixedly to a collar front cover or cover middle 154. The collar front cover 154 is mounted fixedly to and projects downward from the collar 122. The collar front cover 154 is constructed so as to have an opening 156 that is shaped to receive the button actuator 112. When snapped together or otherwise attached to each other, the collar front cover 154 and collar back cover 152 together define a compartment which contains the slide linkage 134, the damper 138, and the push-push follower 136.

Also shown in FIG. 4 is a spout plug or spout seal 158. The spout plug 158 is mounted on the upper interior surface of the hood 116 and is constructed and arranged to fit tightly into or over the spout 114 when the hood 116 is in the closed position such that a leak-proof seal is formed between the hood 116 and the spout 114.

Finally, also shown in FIG. 4 is a detailed enlarged view of the push-push follower 136. The push-push follower 136 has a lower foot 162, a shoulder section 164 and an arm 166. The arm 166 and foot 162 are oriented in opposite directions. On the end of the arm 166 is a tip 168. In FIG. 4, the tip 168 of the push-push follower 136 is shown as a flat section, but its shape is not particularly restricted, so long as the tip 168 is able to press against the interior of the collar back cover 152 when the collar back cover 152 is in position. Likewise, when the collar back cover 152 and the collar front cover 154 are in position, the shoulder section 164 of the push-push follower 136 is pressed against the damper 138. The damper 138 is held in place in the compartment defined by the collar front cover 154 and the collar back cover 152. The damper 138 is constructed (e.g., by suitable material selection) such that it provides enough friction to the shoulder section 164 of the push-push follower 136 to slow down a sliding movement of the shoulder section 164 along the damper 138.

Figure 5:
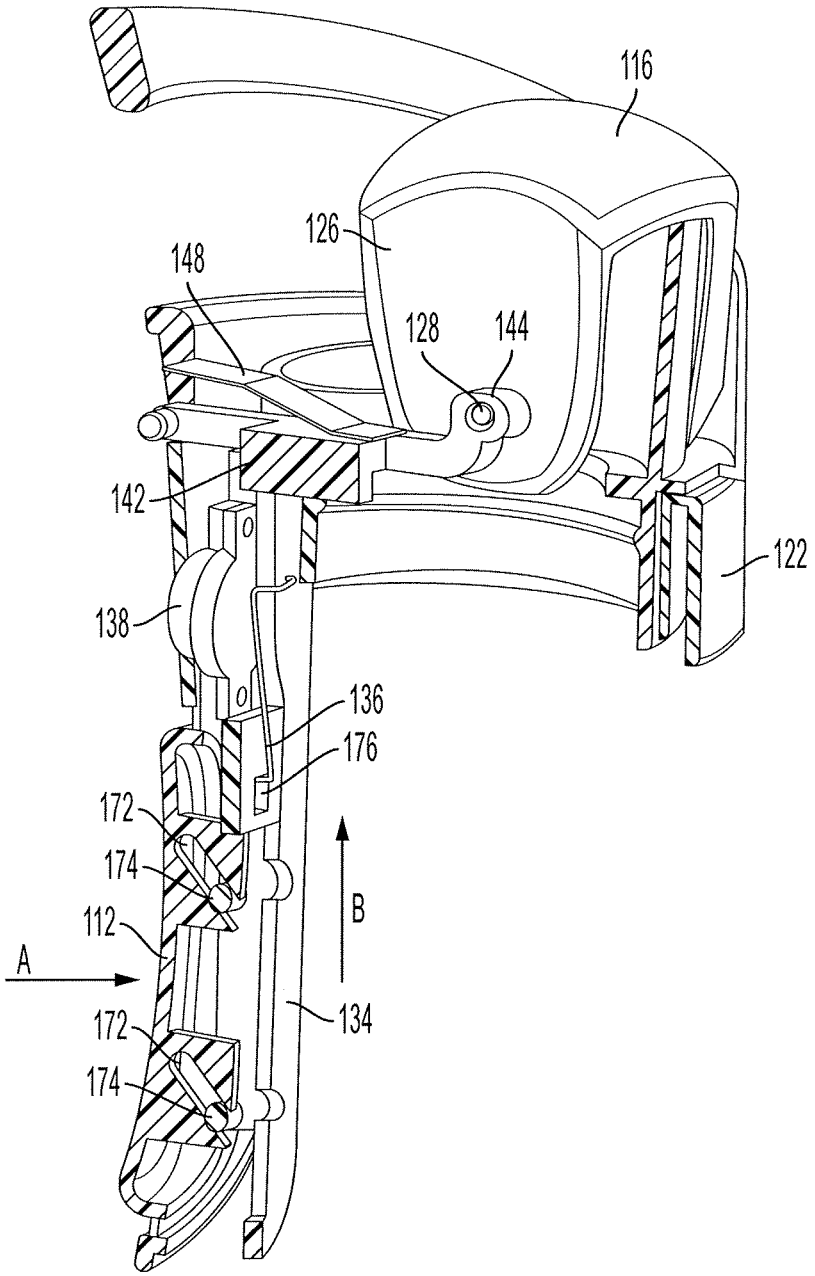
FIG. 5 is a partial cross section of the open-close mechanism of the fitness bottle, showing the components of the open/close mechanism in the closed position of the first embodiment of the fitness bottle.
Figure 6:
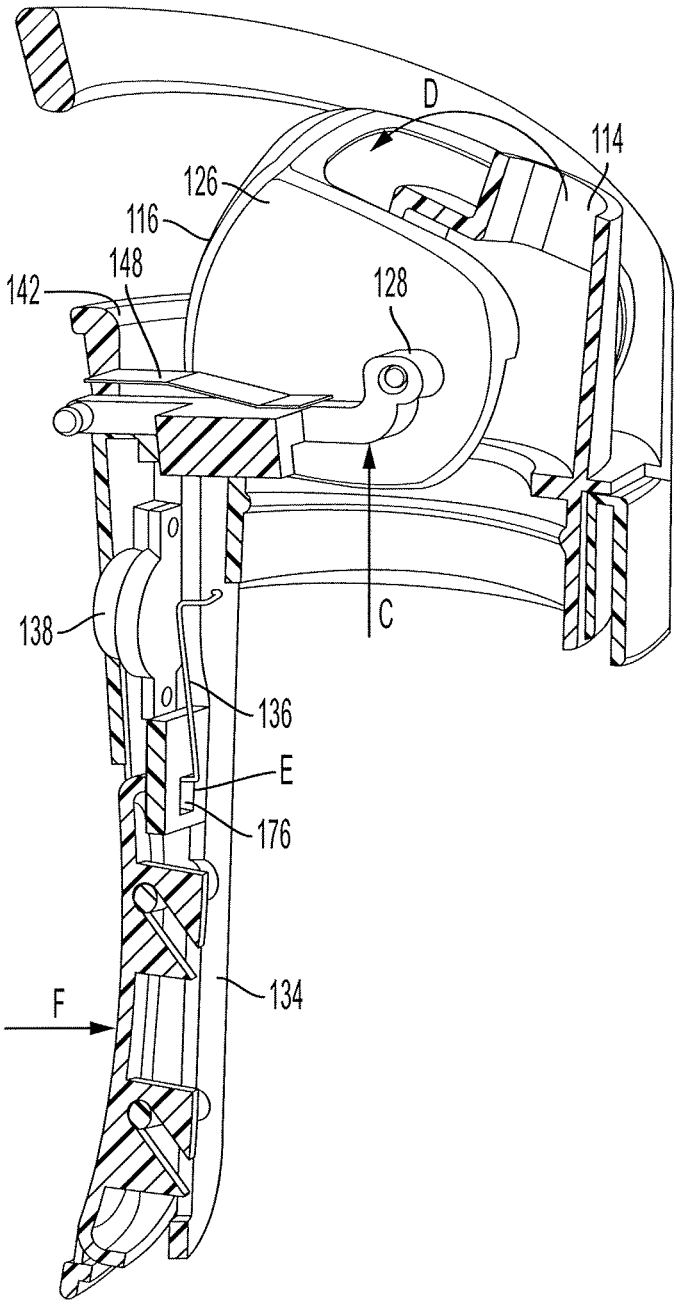
FIG. 6 is a partial cross section of the open-close mechanism of the fitness bottle, showing the components of the open/close mechanism in the open position.

Turning next to FIG. 5, that figure shows a partial cutaway view of a portion of the fitness bottle 10 in the closed position. In FIG. 5 and FIG. 6, the letters A through F show the steps of the open and closing actions of the hood 116. FIGS. 5 and 6 also show the arrangement of the components of the fitness bottle 10 that are involved in the opening and closing action of the fitness bottle 10.

As shown in FIG. 5, the springs 148 press down on the lever 142 to bias it in a downward direction, which holds the hood 116 sealed against the spout 114. In step A, the button 112 is depressed inwardly in the direction of the arrow A. Shown in cutaway in FIG. 5 are two slots 172 on the interior facing side of the button 112. As can be seen in FIG. 5, the slots 172 are oriented diagonally upward from right to left. There are two pins 174 extending from the slide linkage 134 that fit into each of the slots 172. These slots 172 therefore act as cam surfaces that translate the inward movement of the button 112 to an upward movement of the slide linkage 134. Thus, when the person holding the fitness bottle depresses the button 112 inwards, the pins 174 are urged to slide upward in the slots (or cam surfaces) 172, thereby pushing the slide linkage 134 upward, shown by the arrow B in step B. In this way, the depressing movement of the button 112 in a horizontal direction is translated to an upward, vertical movement of the slide linkage 134. Importantly, the slide linkage 112 can be of any convenient length, thereby allowing the button 112 to be placed at any suitable point along the side of the bottle body 110, rather than in close proximity to or even in the same horizontal plane as the fixed spout 114 and the hood 116. Therefore a person holding the fitness bottle 10 can grip the bottle body 110 near or closer to the center of gravity of the fitness bottle 10 when it is full. The vertically lower position of the button 112 relative to the fixed spout 114 is particularly advantageous as the fitness bottle 10 becomes empty and its center of gravity moves lower. Shown also in FIG. 5 is the push-push follower 136, which rides in a track groove 176 that is formed in the slide linkage 134.

Turning next to FIG. 6, step C illustrated by arrow C shows that the slide linkage 134 pushes the lever 142. The upward motion of the lever 142 causes the hood 116 to rotate (step D and arrow D) in a counter clockwise direction (as viewed in FIG. 6), about the end of the lever that is coupled to closure housing 118, to the open position via the pivots 128 on hood legs 126 and the pivot points 144 on the lever 142. The foot 162 of the push-push follower 136 snaps into a notch 178 at the base of the track groove 176, thereby holding the button 112 in the depressed position and also holding the hood 116 in the open position, since the push-push follower 136 holds the slide linkage 134 in position. The shoulder section 164 of the push-push follower 136 presses against the damper 138, thereby slowing the motion of the slide linkage 134, the lever 142, and ultimately slowing the opening action of the hood 116.

Again, note that the button actuator 112 is located vertically below the upward movement of the lever 142, as well as vertically below the pivoting action of the hood 116. Thus, the button 112 can be located at any convenient position along the side of the bottle body 110, or even toward the bottom of the bottle body 110, rather than being constrained to be near the top of the fitness bottle 10 or even possibly in the same horizontal plane as the lever 142 or the pivot 128. This advantage of flexibility in vertical positioning of the button 112 is due to the slide linkage 134, the pins 174, and the notches 172 acting in concert to translate the horizontal inward direction of the button 112 to the vertical upward motion of the slide linkage 134. This upward motion of the slide linkage thus moves the lever 142 that rotates the hood 116 that is located vertically away from the button 112.

Step F illustrated by arrow F in FIG. 6 shows that a second push on the same button 112 serves to move the foot 162 on the push-push follower 136 out of the notch 178, thereby allowing the push-push follower 136 to move to the track groove 176. The push-push follower 136 rides in the track groove 176, which allows the slide linkage 134 to move back down and thereby allowing the lever 142 to rotate in a clockwise direction, and the hood 116 pivots closed to seal the spout 114. Again, the shoulder 164 of the push-push follower 136 presses against the damper 138, thereby slowing the closure of the hood 116. The components ultimately return to their respective positions shown in FIG. 5.

Figure 7:
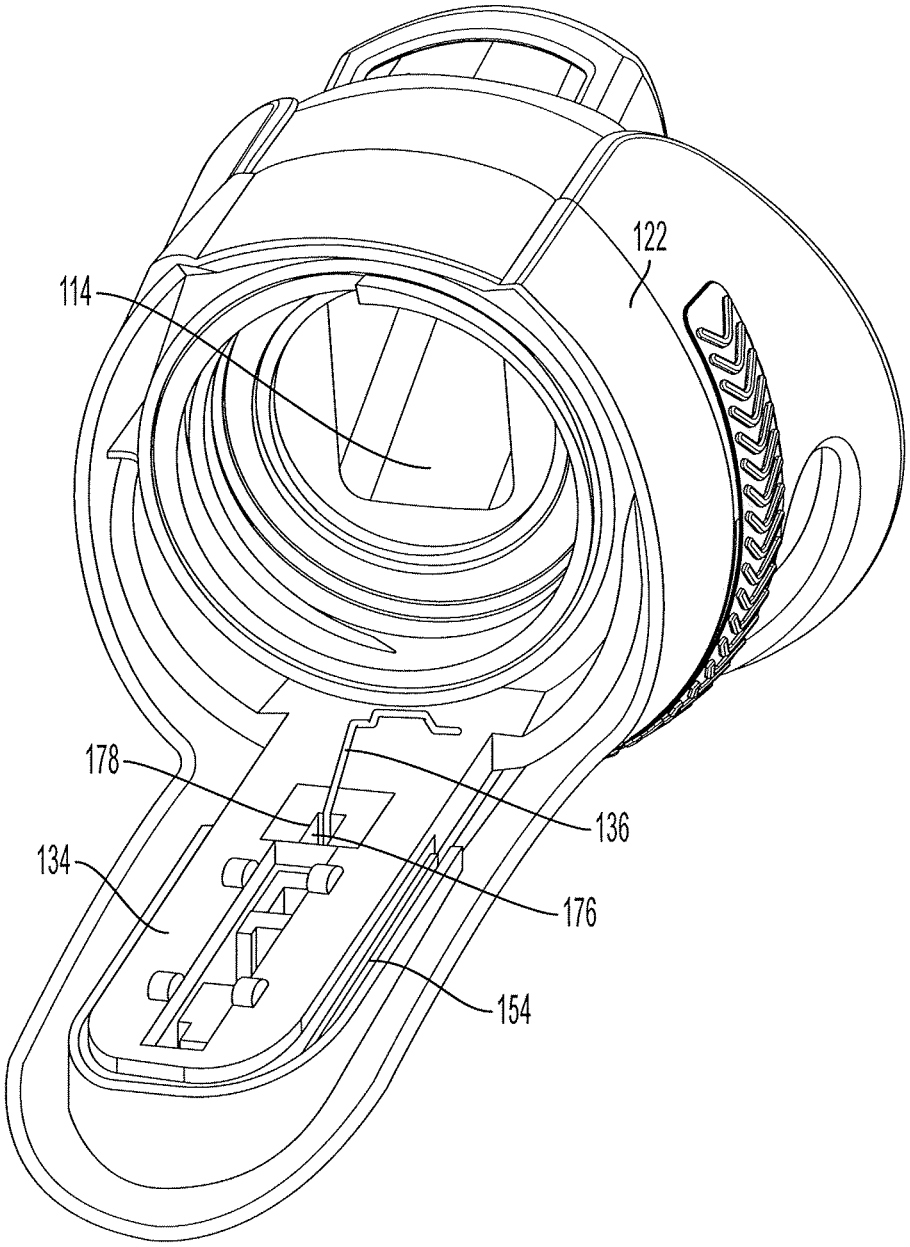
FIG. 7 is a perspective view of a slide linkage in position on an interior face of a button actuator of the open/close mechanism of the first embodiment of the fitness bottle.

FIG. 7 shows a perspective view of the slide linkage 134, in a place behind the button 112 in the compartment defined by the collar front cover 154 and the collar back cover 152 (not shown). FIG. 7 shows a view of the track groove 176 and the notch 178 at the base of the track groove. It can be appreciated from this view of the track groove 176 that the foot 162 of the push-push follower 136 protrudes in the direction of the button 112 through the slide linkage at the notch 178 at the base of the track groove 176 so that the button 112 can push the foot 162 out of the notch 178 and allow the push-push follower 136 to ride in the track groove 176.

Figure 8:
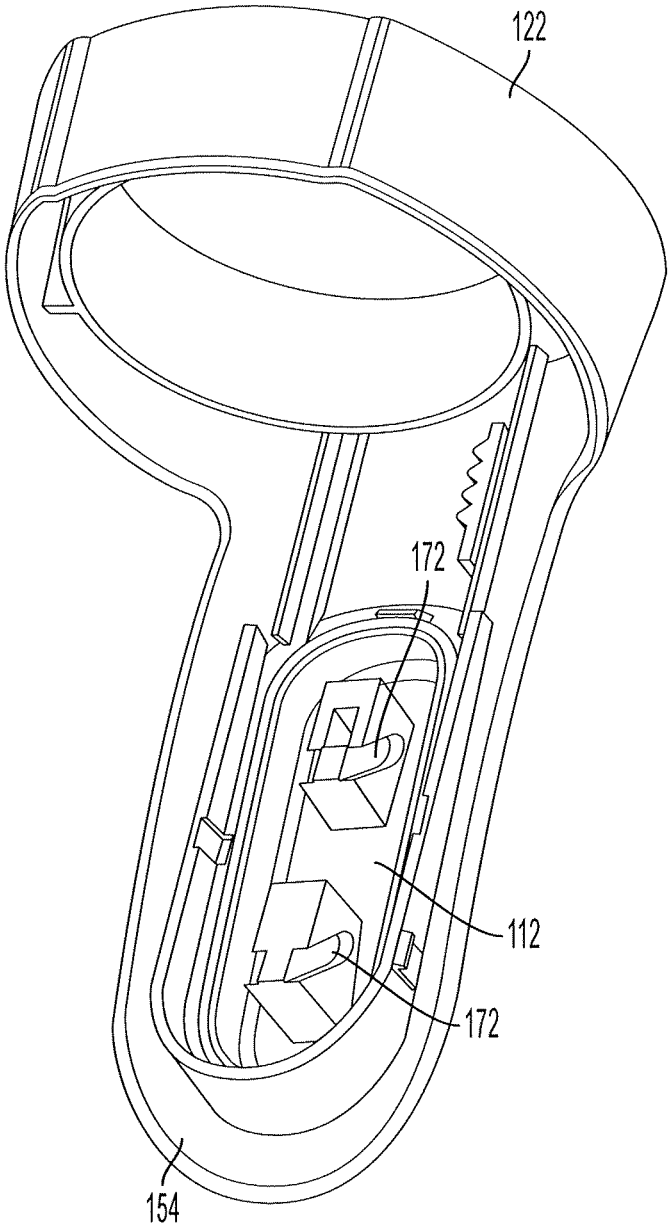
FIG. 8 is a perspective view of the interior face of the button actuator of the open/close mechanism of the first embodiment of the fitness bottle.

FIG. 8 shows a perspective view of the interior of the button 112. As in FIG. 7, the button 112 is shown in place in the compartment defined by the collar front cover 154 and the collar back cover 152 (not shown). In this view, the slide linkage 134 is not shown so that the slots 172 on the interior of the button 112 are visible. The slots 172 are oriented diagonal to a pushing direction (see arrow A in FIG. 5) of the button 112. The slide linkage 134 moves perpendicular to the pushing direction.

Figure 9:
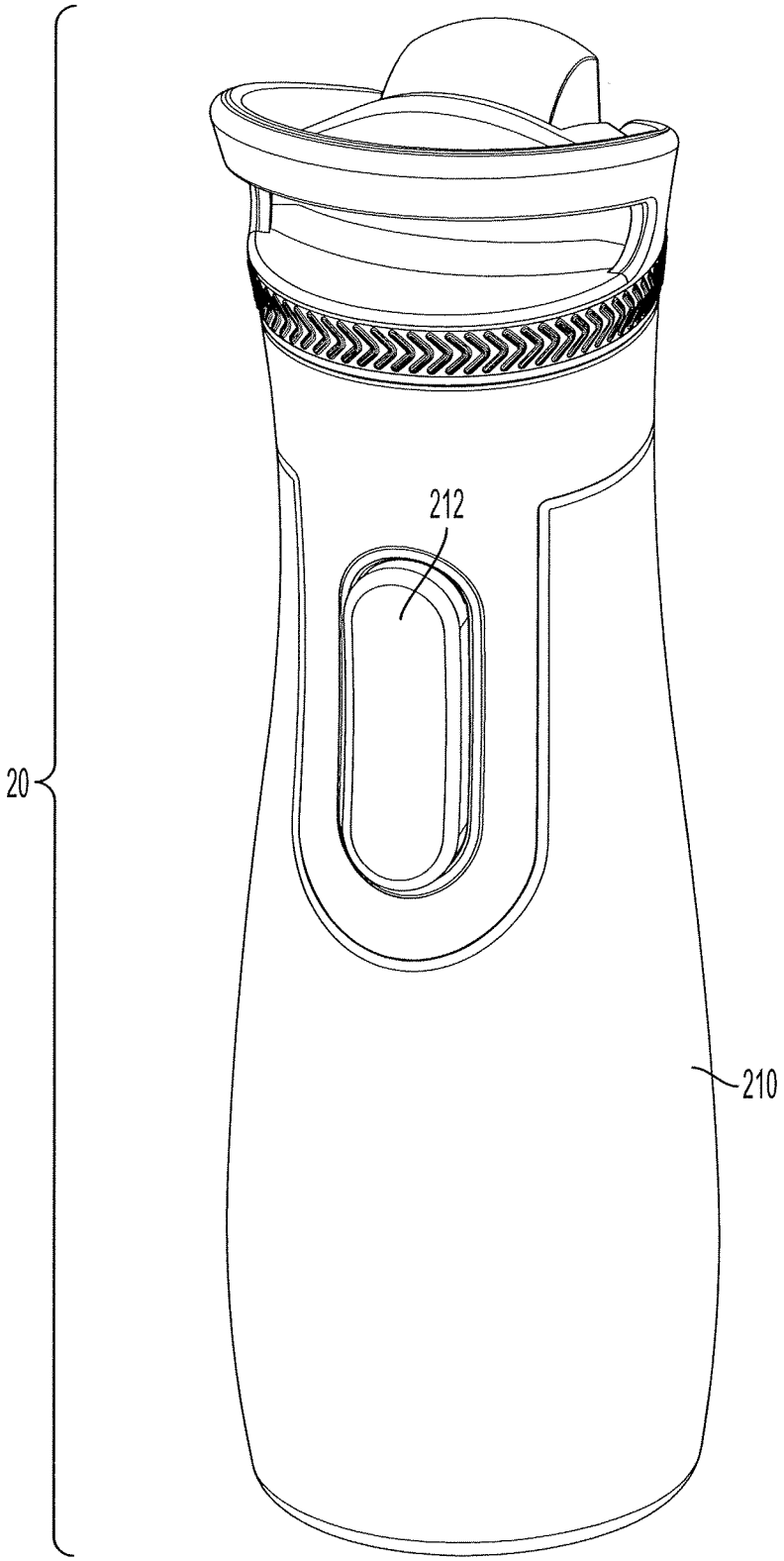
FIG. 9 is a perspective view of a fitness bottle in accordance with a second exemplary embodiment of the invention.

FIG. 9 shows a perspective view of a second embodiment of a fitness bottle or cup 20. The fitness bottle 20 comprises a bottle body 210 which is constructed and arranged to contain liquid. Also shown in FIG. 9 is a button actuator 112 that is arranged to be pushable by one hand or preferably one finger of a person holding the fitness bottle 10. As will be shown in detail in the following description, the button actuator 112 is linked to a "push-push" mechanism whereby a single push depressing the button actuator will open the fitness bottle 10 if it is closed, or the single push to depress the button actuator 112 will close the fitness bottle 20 if it is open. The action of depressing the button actuator is thus translated via a linkage that serves to open or close the fitness bottle. This second embodiment of the fitness bottle 20 is similar to the first embodiment 10 in many respects, but the "push-push" mechanism of the second embodiment is somewhat different from the first embodiment. Importantly, the "push-push" mechanism of the second embodiment, like the first embodiment, enables a horizontal action of depressing the button actuator 212 to translate to a vertical movement of a slider that effects a rotational movement of opening of a closure. Also like the first embodiment, the second embodiment's "push-push" action should be understood as meaning that one push of the button opens a closed bottle. The bottle will then stay open until the same button is pushed again, which results in closing of the bottle, which will stay closed until the button is pushed again, and so on.

Figure 10B:
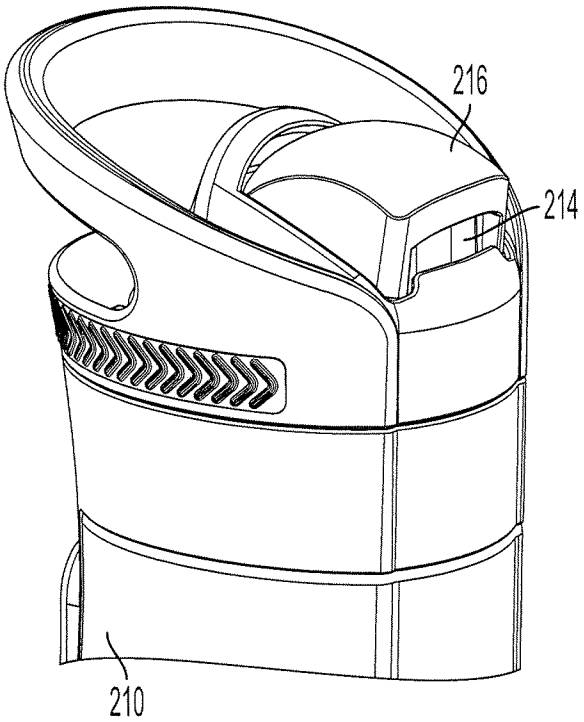
FIGS. 10A and 10B are perspective views of the second embodiment of the fitness bottle showing the bottle in the open and closed positions, respectively.
Figure 10A:
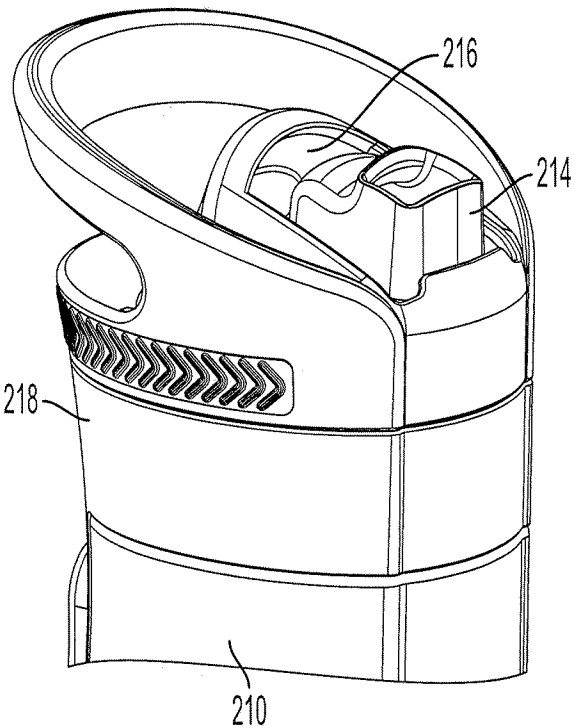

FIGS. 10A and 10B show top perspective views of the fitness bottle 20 in the open position and the closed position, respectively. Shown in FIG. 10A, in the open position, is a stationary spout 214. Liquid contained in the bottle body 210 can flow freely through the stationary spout 214 when the fitness bottle 20 is open. FIG. 10B shows the fitness bottle 20 in the closed position, wherein a moveable hood 216 has moved from a closure housing 218 to seal the stationary spout 114. Turning again to FIG. 10A, the hood 216 is visible in the open position where the hood 216 has moved away from the spout 214 and into the closure housing 218.

Figure 11:
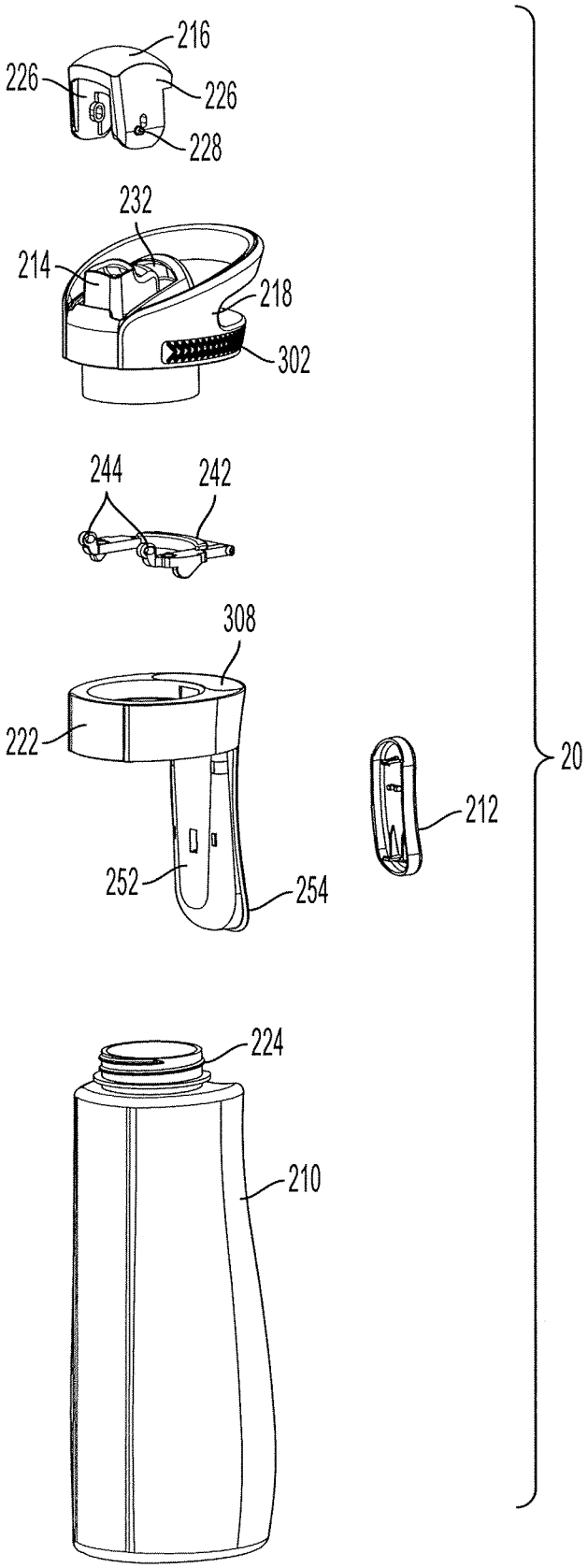
FIG. 11 is an exploded view showing some of the components of the second embodiment of the fitness bottle.

FIG. 11 is an exploded view of the fitness bottle 20 showing certain of the components of this second embodiment. As can be seen in FIG. 11, the closure housing 218 is constructed to fit into a collar 222 and to also removably couple with the bottle body 210 in order to provide a leak-proof or leak-resistant seal to the bottle body 210. As shown in FIG. 11, this seal can be effected by attaching the closure housing 218 to a neck 224 on the bottle body 210. A leak-proof seal can comprise any means such as are known in the art, for instance via a snap-tight seal or a screw-on seal or a quarter-turn seal.

Also shown in FIG. 11 is the hood 216. The hood 216 has a rounded top surface and two legs 226 depending therefrom. Each leg 226 has a pivot projection 228. Only one pivot projection 228 is visible in FIG. 11. As shown in FIG. 11, the pivot projections 228 extend from the exterior surface of each hood leg 226 and are constructed and arranged to fit into matching pivot points 244 on a lever 242. The hood 216 and legs 226 are constructed and arranged to fit into a hood aperture 232 in the closure housing 218. Note that the hood aperture 232 extends about the spout 214. Also shown in FIG. 11 is the button actuator 212, as well as a collar back cover or main case 252 and a collar front cover or middle of case 254. As shown in FIG. 11, these two components depend from the collar 222. Shown also in FIG. 11 is a top decorative strip 302 which is attached to the closure housing 218, as well as a decorative cover middle 308 that is attached to the top of the collar 222.

Figure 12:
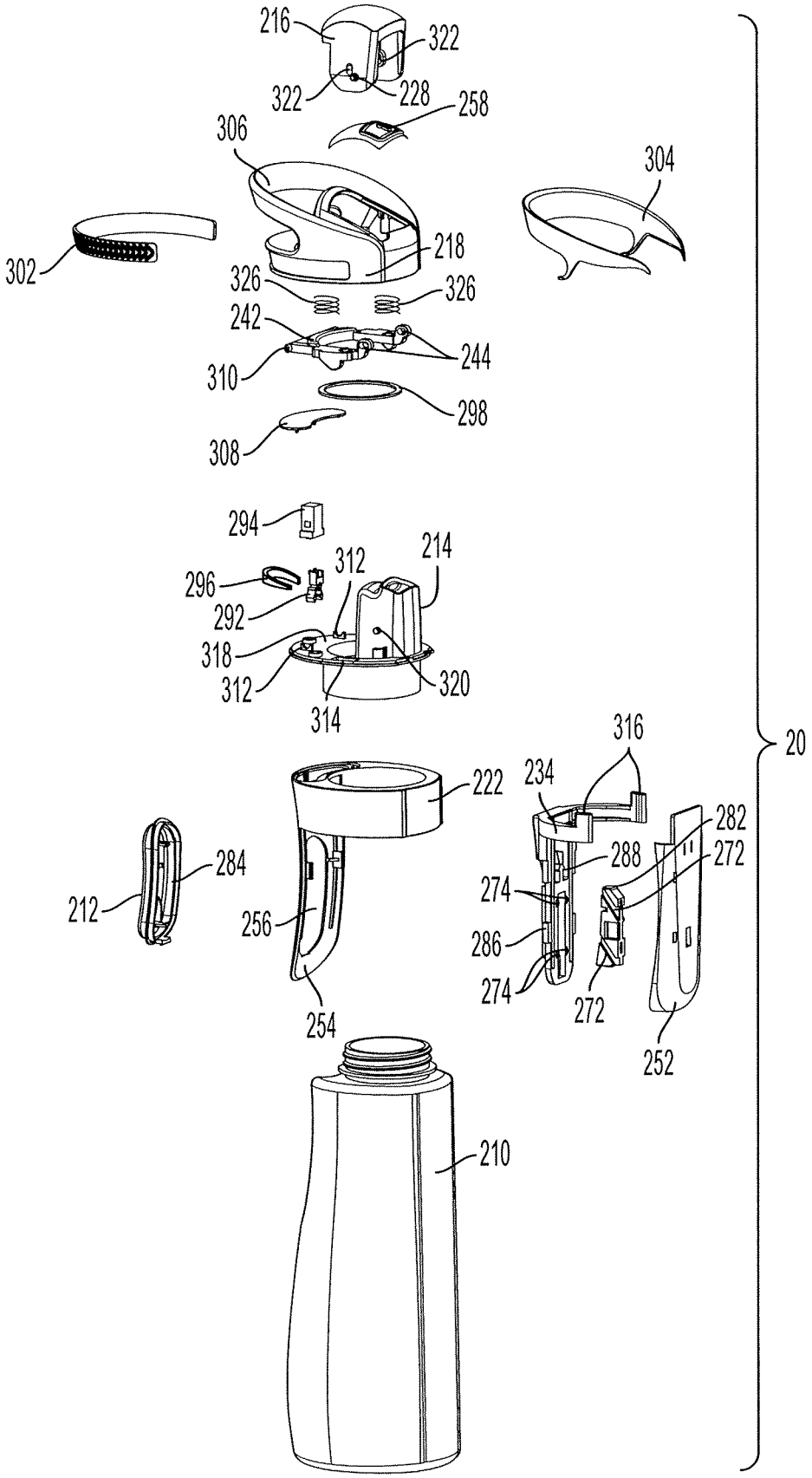
FIG. 12 is an exploded view showing additional components of the second embodiment of the fitness bottle.

Turn next to FIG. 12, which shows an exploded view of the components of the fitness bottle 20. These components will be listed briefly here and the details of the components and operation of the "push-push" mechanism will be described here, as well as in more detail in subsequent drawing figures.

Shown in FIG. 12 in addition to the components listed previously, is a slide linkage, also called a slider 234. As will be shown in more detail in subsequent figures, the slide linkage or slider 234 is constructed and arranged so as to translate movement of the button 212 into movement of the hood 216 from the open position to the closed position or vice-versa. Also shown is the lever 242. The lever 242 comprises the two pivot points 244. These pivot points 244 are arranged so as to mate with the pivots or pivot projections 228 on the hood legs 226 that are mounted on hood 216, thereby allowing the hood 216 to move pivotally from the open to the closed position or vice-versa. Looking closely at both the hood 216 and the spout 214, one can see that the spout also has two pivot projections 320 (only one is visible) and the hood 216 has two oblong-shaped pivot points 322. These oblong pivot points 322 are constructed and arranged to rotatably and slidably (due to the oblong shape, both movements are possible) accept the pivot projections 320 on the spout 214. Therefore, when the hood 216 rotates about the pivot projections 228 due to the lever 242, the hood 216 also rotates and slides about these pivot points 322.

The lever 242 is arranged to contact the slider 234, such that the slider 234 is able to rotate the lever 242, thereby effecting pivoting motion of the hood 216. Note that the slider 234 also has two upward fingers 316, and that the spout 214 has a circumferential shoulder 318 in which are apertures 314 (only one is visible). These apertures 314 are constructed and arranged so that the upward fingers 316 fit therethrough and thus when the slider 234 moves upward, these fingers 316 project through the apertures 314 up beyond the plane of the shoulder 318 and will then urge the lever 242 upwards, which movement causes the hood 216 to rotate open, as described above. The lever 242 also has two pivot projections 310 (only one is visible). The circumferential shoulder 318 has two pivot points 312, which are constructed and arranged to accept the pivot projections 213 on the lever 244. The lever 244 will therefore rotate upward around the pivot projections 310 when urged upwards by the fingers 316 on the slider 234.

Also shown is the button switch middle 282. The button switch middle 282 is constructed and arranged to be fixed or attached (e.g. with clips) on the interior face 284 of the button 212. In addition, looking closely at the button middle 282, one can see that it defines four (two are visible) slots 272. Likewise, looking closely at the slider 234, it can be seen that there is a slider aperture 286 in the slider 234. This slider aperture 286 is sized so as to accept the button middle 282. In addition, there are four pins 274 which are constructed and arranged to slidably engage with the four slots 272 on the button middle 282.

Finally, examining the slider 234, one can see an arrow-shaped catch 288 projecting vertically upwardly from the slider 234. This catch 288 is constructed and arranged to fit removably into a clip 292. This clip 292 fits into a clip housing 294. The clip housing 294 and thereby the clip 292 are fixedly mounted to the collar 222. Also shown is a spring clip 296 which is constructed and arranged to bias the clip 292 open. Together, the clip 292, the clip housing 294, and the spring clip 296 comprise a push-push switch.

Shown also in FIG. 12 is the collar back cover 252 which is constructed to snap onto or otherwise attach fixedly to the collar front cover 254. The collar front cover 254 is mounted fixedly to and projects downward from the collar 222. The collar front cover 254 is constructed so as to have an opening 256 that is shaped to accept the button actuator 212. When snapped together or otherwise attached to each other, the button actuator (also called button switch top) 212, collar front cover 254 and collar back cover 252 together define a tongue-shaped compartment which contains the slider 234, the button switch middle 282, the clip 292, the clip housing 294, and the spring clip 296. This is shown in FIG. 11, where collar front cover 254 and collar back cover 252 are shown in their snapped-together configuration.

Referring back to FIG. 9, one can appreciate that at least a part of this tongue-shaped compartment, which carries the button actuator (also called button switch top) 212, and which is defined by the collar front cover 254 and collar back cover 252, is configured and arranged to be generally or completely flush with at least a part of the outer surface of the bottle body 210. Further, this tongue-shaped compartment, or extension, which depends downward from the collar 222 is advantageous in that it allows the button actuator 212 and slider 234 (carried by the compartment) to be positionable along the side of the bottle body 210 and below the neck 224 of the bottle body 210 and toward a midsection of the bottle body 210 where a user would prefer to grasp it.

The tongue-shaped compartment is tongue-shaped in that it extends downwardly from the top portion of the closure assembly such that the bottom end of the tongue-shaped compartment is spaced downwardly away from the closure and spout of the fitness bottle. The tongue-shaped portion can be provided with a wide variety of shapes and configurations. It can have a rounded configuration like a human tongue or can have any combination of flat or rounded or angled surfaces, depending on design preferences and other considerations. For example, the tongue-shaped portion can be square or rectangular or any other geometric shape. Also, it can have a width that extends partially around the circumference of the bottle body (as shown in the embodiments selected for illustration herein) or can extend farther or even completely around the circumference of the bottle's body. Accordingly, the tongue-shaped portion can have a wide variety of shapes and sizes.

Figure 13:
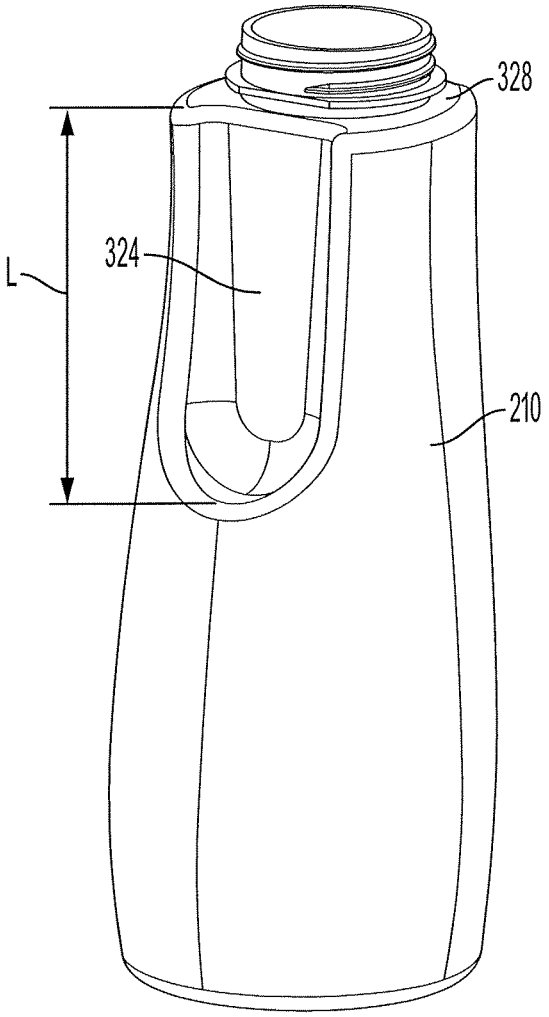
FIG. 13 is a perspective view of a body of the second embodiment of the fitness bottle.

Refer now to FIG. 13 which shows another view of the bottle body 110. In this view, it is seen that the bottle body 210 defines an indentation 324 that provides a recessed portion or concavity such as a deviation from the rounded circumferential shape of the bottle body.

As shown in FIG. 13 for example, the indentation 324 extends downwards a length L along a side of the bottle body 210. Referring back to FIGS. 11 and 9, it will be appreciated that the indentation 324 is positioned and configured to at least partially accept the tongue-shaped extension. This is possible because a depth of the indentation 324 corresponds to a thickness of the extension in this embodiment. Thus, at least a part of the extension will be completely or generally flush with the outer surface of the bottle body 210 adjacent the indentation 324, as can be seen in FIG. 9.

Also shown in FIG. 13 is an upper shoulder surface 328 of the bottle body 210. This shoulder surface 328 is sized and configured so that it will accept the collar 222 of the closure assembly, thereby enabling the collar 222 to be at least partially flush with the exterior of the bottle body 210. The collar is also shown in FIG. 9 as flush with the body 210. The tongue-shaped portion of the fitness bottle extends downwardly below the upper shoulder surface 328 of the bottle body 210, thus making it possible to position the bottom of the actuator below the upper shoulder surface 328 and, more preferably, at a location where the entire actuator or button is located at a position spaced below the upper shoulder surface 328.

In this way, the fitness bottle 20 is configured to be easy and convenient for a user to grasp the bottle 20 below its top with one hand and depress the button actuator 212 with one finger of that hand to effect opening and closing of the bottle 20. In other words, it permits the user to grasp the fitness bottle 20 at a single desired location not only in terms of comfort and convenience and intuitive use of the fitness bottle 20, but also in terms of single hand or single finger operation of the button actuator.

Additionally, as can be appreciated from the various Figures, the section of the bottle 20 located where the button actuator is positioned can optionally have a smaller diameter, optimally sized to be graspable by one hand, thereby further making the use of the bottle 20 ergonomic and intuitive, and actually encouraging the user to grasp the bottle 20 at the location of greatest comfort and at the location of the actuator button. It will be appreciated that many ornamental shapes and configurations can be provided for the bottle while still providing a smaller diameter near the button actuator, such as for example gently or abruptly tapered contours, or angular surfaces, or rounded or defined edges.

The length L of the indentation can be any fraction of the height of the bottle body 210. Non-limiting examples of length L are ¼ or less, or ⅓ or less, or ½ or less, or ⅔ or less of the height of the bottle 20, but shorter or longer lengths are also contemplated.

Also shown in FIG. 12 is a spout plug 258. The spout plug (also called a seal) 258 is mounted on the upper interior surface of the hood 216 and is constructed and arranged to fit tightly into the spout 214 when the hood 216 is in the closed position such that a leak-proof or leak-resistant seal is formed between the hood 216 and the spout 214. Further, note that in this second embodiment, the spout 214 is shown as a separate part from the closure housing 218 (unlike the first embodiment), but that the spout 214 and the closure housing 218 are constructed and arranged to fit together in a leak-proof or leak-resistant way. This is done in this second embodiment by way of a gasket 298 that is interposed between the closure housing 218 and the spout 214.

Shown once again in FIG. 12 is the top decorative strip 302, and a decorative handle interior 304. Note that as shown in FIG. 12, the closure housing 218 can define a handle 306. Also shown is the decorative cover middle 308 that is fixedly attached to the collar 222.

Referring to FIG. 12, the steps in operation of the fitness bottle are as follows.

First the button 212 is depressed inwardly. As can be seen in FIG. 12, the slots 272 are oriented diagonally upward. There are pins 274 extending from the slide linkage 234 that fit into each of the slots 272. These slots 272 therefore act as cam surfaces that translate the inward movement of the button 212 to an upward movement of the slide linkage 234. Thus, when the person holding the fitness bottle depresses the button 212 inwards, the pins 274 are urged to slide upward in the slots (or cam surfaces) 272, thereby pushing the slide linkage 234 upward. In this way, the depressing movement of the button 212 in a horizontal direction is translated to an upward, vertical movement of the slide linkage 234.

Importantly, the slide linkage 212 can be of any convenient length, thereby allowing the button 212 to be placed at any suitable point along the side of the bottle body 210, rather than in close proximity to or even in the same horizontal plane as the fixed spout 214 and the hood 216. Therefore, a person holding the fitness bottle 10 can grip the bottle body 210 near the center of gravity of the fitness bottle 10 when it is full. The vertically lower position of the button 212 relative to the spout 214 is particularly advantageous as the fitness bottle 20 becomes empty and its center of gravity moves lower. Shown also in FIG. 12 is the catch 288 on the slide linkage 234.

The slide linkage 234 moves upward and pushes the lever 242 upwards. The upward motion of the lever 242 causes the hood 216 to rotate about the end of the lever 242 that is coupled to closure housing 218 to the open position via the pivots 228 on hood legs 226 and the pivot points 244 on the lever 242. The catch 288 on the slide linkage 234 thus simultaneously engages the clip 292 and urges it upward into the housing 294. The interior (not shown) of the housing 294 is shaped to urge together the clip 292, against the bias of the spring clip 296. Thus, the hood 216 is held in place.

Again, note that the button actuator 212 is located vertically below the upward movement of the lever 242, as well as vertically below the pivoting action of the hood 216. Thus, the button 212 can be located at any convenient position along the side of the bottle body 210, rather than being constrained to be near the top of the fitness bottle 20 or even possibly in the same horizontal plane as the lever 242 or the pivot 228. This advantage of flexibility in vertical positioning of the button 212 is due to the slide linkage 234, the pins 274, and the notches 272 acting in concert to translate the horizontal inward direction of the button 212 to the vertical upward motion of the slide linkage 234. This upward motion of the slide linkage 234 thus moves the lever 242 that rotates the hood 216 that is located vertically away from the button 212.

When the button actuator 212 is pushed again, the movement pushes the slider 234 up a small amount, which disengages the clip 292 from the interior of the housing 294 due to the bias of the spring clip 296. The clip 292 thus disengages from the catch 288 on the slider. The slider 234 can move vertically downward, which allows the lever 242 to lower, since it is urged downward by compression springs 326, which in turn causes the hood 216 to rotate to the closed position. These compression springs 326 are positioned on the top of the lever 242 near the pivot projections 244 in the top of the lever 242 and then press against the underside of the closure housing 218.

Figure 14:
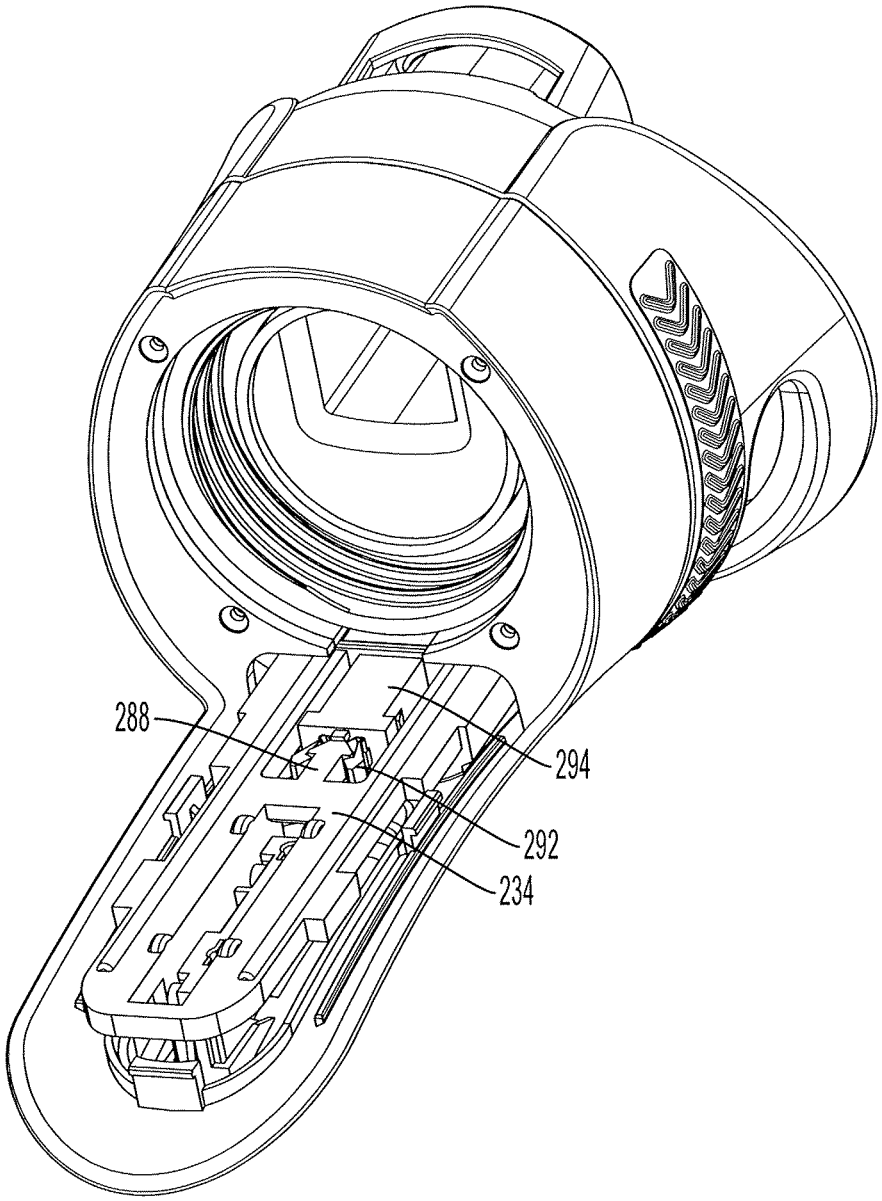
FIG. 14 is a perspective view of a slide linkage in position on an interior face of a button actuator of the open/close mechanism of the second embodiment of the fitness bottle.

FIG. 14 shows a perspective view of the slide linkage 234, in place behind the button 212 in the compartment defined by the collar front cover 254 and the collar back cover 252 (not shown). This view shows how the catch 288 is held in place in the clip 292, which in turn is held in place by the clip housing 294.

Figure 15:
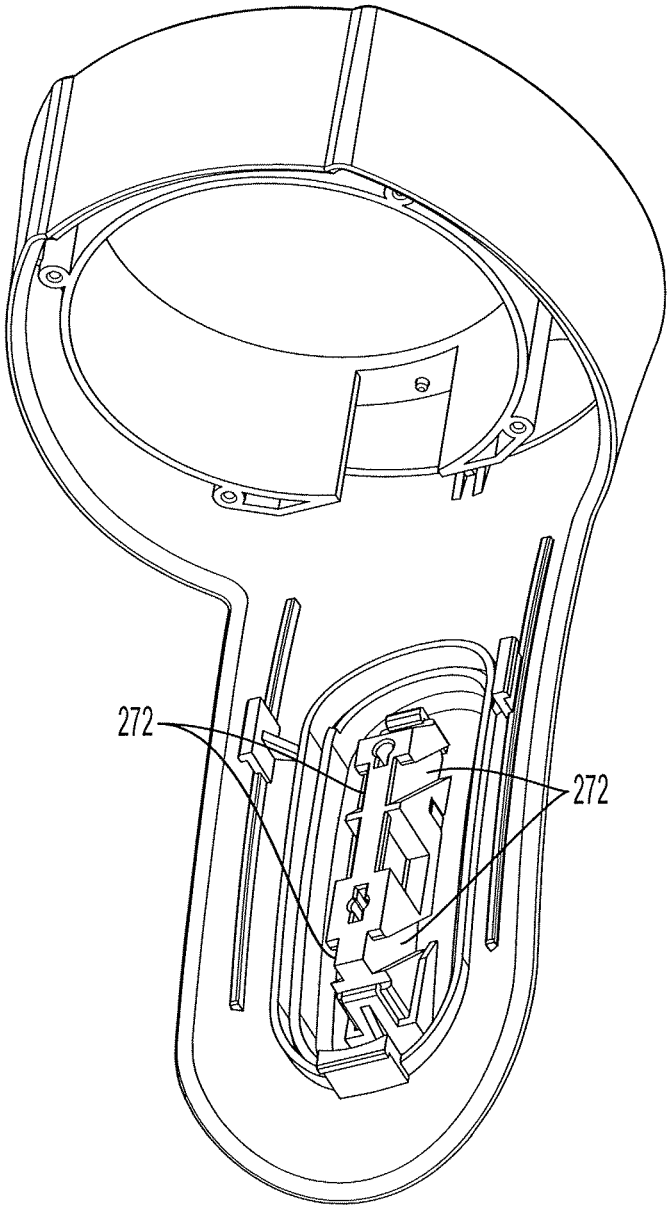
FIG. 15 is a perspective view of the interior face of the button actuator of the open/close mechanism of the second embodiment of the fitness bottle.

FIG. 15 shows a perspective view of the interior of the button 212. As in FIG. 14, the button 212 is shown in place in the compartment defined by the collar front cover 254 and the collar back cover 252 (not shown). In this view, the slide linkage 234 is not shown, so that the slots 272 on the button switch middle 282 are visible. The slots 272 are oriented diagonal to a pushing direction (see arrow A in FIG. 13) of the button 212. The slide linkage 234 moves perpendicular to the pushing direction.

The various components described herein can be made of any suitable material. Non-limiting examples include rigid plastic materials such as acrylonitrile butadiene styrene (ABS) for the button 112 or 212, spout 114 or 214, hood 116 or 216, closure housing 118 or 218, collar 122 or 222, slide linkage 134 or 234, lever 142 or 242, collar back cover 152 or 252, and collar front cover 154 or 254. The bottle body 110 or 210 can be made of polyester such as polyethylene terephthalate, or other suitable polymers, whether homopolymers or copolymers. Clear or translucent plastic materials are preferred for the bottle body 110 or 210 so that the liquid level in the bottle is easy to assess. The spring clip 296 is preferably made from steel. The spout plug 158 or 258 and the gasket 298 can be made of a thermoplastic elastomer. Nevertheless, various polymeric or metallic materials and other materials can be selected depending on cost and manufacturing considerations and preferences.

In a method of use for operating the fitness bottle according to an aspect of the invention, the method includes the steps of (a) at least partially filling a body of the fitness bottle with a liquid; (b) coupling a closure assembly of the fitness bottle to the body of the fitness bottle, wherein step a) and step b) can be performed in any order; and (c) actuating an actuator associated with the body or the closure assembly, the actuating including opening actuation to move the closure assembly from a closed configuration to an open configuration and closing actuation to move the closure from the open configuration to the closed configuration. The opening actuation includes translating a linkage extending between the actuator and a closure of the closure assembly to change the position of the closure relative to a spout of the closure assembly to unseal an opening of the spout of the closure assembly by the closure of the closure assembly, thereby moving the closure assembly from the closed configuration to the open configuration. The closing actuation includes translating the linkage to change the position of the closure relative to the spout to seal the opening of the spout of the closure assembly with the closure of the closure assembly, thereby moving the closure assembly from the open configuration to the closed configuration.

The actuating step can include depressing the actuator for the opening actuation of the actuator and depressing the actuator for the closing actuation of the actuator. The actuating step can also include depressing the actuator toward a center of the body of the fitness bottle for the opening actuation of the actuator and depressing the actuator toward the center of the body of the fitness bottle for the closing actuation of the actuator. The actuating step can include push-push actuation to open and close the closure assembly, respectively.

In a method of use for assembling a fitness bottle according to another aspect of the invention, the method includes the steps of removably coupling a closure assembly to a body configured to contain a liquid, the closure assembly having an open configuration allowing the liquid to flow from the body through the closure assembly and a closed configuration restricting flow of the liquid from the body through the closure assembly, the closure assembly having a spout defining an opening through which the liquid can flow when the closure assembly is in the open configuration; positioning a closure for relative movement with respect to the spout such that the closure is positionable to seal an opening defined by the spout when the closure assembly is in the closed configuration; coupling an actuator to the body or the closure assembly for opening actuation by the user to move the closure assembly from the closed configuration to the open configuration and for closing actuation by the user to move the closure assembly from the open configuration to the closed configuration; and extending a linkage between the actuator and the closure of the closure assembly to translate the opening actuation of the actuator to change the position of the closure relative to the spout to unseal the opening of the spout of the closure assembly by the closure of the closure assembly, thereby moving the closure assembly from the closed configuration to the open configuration, and to translate the closing actuation of the actuator to change the position of the closure relative to the spout to seal the spout of the closure assembly with the closure of the closure assembly, thereby moving the closure assembly from the open configuration to the closed configuration.

The positioning step can include positioning a lever to effect movement of the closure. The coupling step can include positioning the actuator adjacent a side wall of the body. The coupling step can also include positioning the actuator at a location below the closure assembly. The extending step can include extending the linkage vertically between the actuator and the closure of the closure assembly whereby a horizontal opening actuation of the actuator is translated to a vertical movement of the linkage which results in the movement of the closure relative to the spout to unseal the opening of the spout of the closure assembly by the closure of the closure assembly, thereby moving the closure assembly from the closed configuration to to the open configuration, and whereby the horizontal closing actuation of the actuator is translated to a vertical movement of the linkage which results in movement of the closure relative to the spout to seal the opening of the spout of the closure assembly with the closure of the closure assembly, thereby moving the closure assembly from the open configuration to the closed configuration.

Among the advantages conferred by exemplary embodiments of this invention as described above, it is made possible to provide a fitness bottle that can be operated by a single push of a button that serves to open the bottle if it is closed and to close the bottle if it is open. For example, the opening and closing mechanism of the fitness bottle can be rendered operable using just one finger of just one hand, the finger being on the same hand that is holding the bottle. This makes it possible to grasp and operate the bottle with only one hand and to eliminate any need to use both hands at the same time or sequentially to grasp and operate the bottle. It also makes it possible to actuate the opening and closing mechanism with only one finger of one hand, using the same finger and same action to open and close the fitness bottle.

Another advantage conferred by exemplary embodiments of this invention is that it is made possible for the user of the fitness bottle to grasp the fitness bottle in a natural way and at a natural location, and to operate the opening and closing mechanism without adjusting the position of the user's hand. For example, embodiments of the fitness bottle permit a user to grasp the fitness bottle at a location that is spaced from the top of the fitness bottle, e.g., below the top portion of the fitness bottle or below the closure assembly of the fitness bottle, and still operate the opening and closing mechanism. This is made possible, in embodiments of the invention, by the mechanism that translates the actuation of a button positioned at a location spaced below the top of the fitness bottle into actuation of the closure assembly toward the top of the fitness bottle to open or close the closure. Accordingly, a user can grasp the fitness bottle at a location spaced from its top and closer to its center of gravity, operate the button to open and/or close the closure, and release the fitness bottle without adjusting the position of the user's hand along the fitness bottle.

Yet another advantage conferred by exemplary embodiments of this invention is that it is made possible to reduce or eliminate the need to touch or handle, by the user's hand, components of the fitness bottle, thereby reducing the transfer of germs from the user's hand to the liquid or user's mouth. For example, a user can avoid touching the spout or closure or other components of the closure assembly with the user's hand or fingers so that germs will not be transferred to the user's mouth or to liquid in the fitness bottle.

It will be appreciated that the functionality of the fitness bottle described herein can be achieved using a wide variety of ornamental designs. In other words, a wide variety of ornamental designs can be selected for the fitness bottle, and such designs may be selected based on aesthetics, source identification, and other motivations. Accordingly, the ornamental appearance of the fitness bottle is independent from its functional operation and can be varied from those disclosed herein, while still achieving the functional advantages of this invention. Such variations may include, for example, the shape, size, color scheme, contour, proportions, materials, and other variations.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A fitness bottle operable by one hand of a user during exercise, the fitness bottle comprising:

a body configured to contain a liquid; and a closure assembly removably coupled to the body, the closure assembly having an open configuration allowing the liquid to flow from the body through the closure assembly and a closed configuration restricting flow of the liquid from the body through the closure assembly, the closure assembly having a spout defining an opening through which the liquid can flow when the closure assembly is in the open configuration, a closure configured to seal the opening of the spout when the closure assembly is in the closed configuration and to unseal the opening of the spout when the closure is in the open configuration, wherein the position of the closure relative to the spout changes upon movement of the closure assembly from the open configuration to the closed configuration, an actuator positioned for opening actuation by the user to move the closure assembly from the closed configuration to the open configuration and for closing actuation by the user to move the closure assembly from the open configuration to the closed configuration, and a linkage coupled to the actuator, the linkage being configured to translate the opening actuation of the actuator to move the closure assembly from the closed configuration to the open configuration to unseal the opening of the spout of the closure assembly by the closure of the closure assembly, and the linkage also being configured to translate the closing actuation of the actuator to move the closure assembly from the open configuration to the closed configuration to seal the opening of the spout of the closure assembly by the closure of the closure assembly;

wherein the actuator defines a cam surface oriented to operate the linkage upon the opening actuation and the closing actuation;

wherein the opening actuation and the closing actuation of the actuator comprises movement in an inward direction toward a center of the body, and wherein the cam surface is configured and arranged to convert the movement of the actuator in the inward direction to a movement of the linkage toward a top of the fitness bottle; and wherein the movement of the linkage toward the top of the fitness bottle is a vertical movement.

2. The fitness bottle of claim 1, wherein the actuator and the linkage are configured such that the opening actuation of the actuator and the closing actuation of the actuator are both achieved by depressing the actuator.

3. The fitness bottle of claim 2, wherein the actuator and the linkage are configured such that the opening actuation of the actuator and the closing actuation of the actuator provide push-push actuation to open and close the closure assembly, respectively.

4. The fitness bottle of claim 1, further comprising a damper positioned (1) to retard motion of the closure relative to the spout to unseal the opening of the spout, (2) to retard motion of the closure relative to the spout to seal the opening of the spout, or (3) to retard motion of the closure relative to the spout to unseal the opening of the spout and to retard motion of the closure relative to the spout to seal the opening of the spout.

5. The fitness bottle of claim 1, the linkage comprising a lever positioned to convert translation of the linkage to motion of the closure.

6. The fitness bottle of claim 5, the linkage comprising a slider that contacts the lever.

7. The fitness bottle of claim 1, wherein the body defines an indentation on an exterior side surface thereof, and wherein the indentation is configured and positioned to at least partially receive the closure assembly.

8. The fitness bottle of claim 7, wherein the closure assembly comprises a tongue-shaped extension depending downward therefrom, wherein the extension carries the actuator, and wherein a depth of the indentation corresponds to a thickness of the tongue-shaped extension.

9. The fitness bottle of claim 8, wherein the indentation and the tongue-shaped extension extend at least partially along the length of the body such that a bottom end of the extension and the actuator are spaced below the top of the body and toward a midsection of the body.

10. The fitness bottle of claim 1, the closure comprising a sealing surface positioned to form a leak-proof or leak-resistant seal of the opening of the spout when the closure assembly is in the closed configuration.

11. The fitness bottle of claim 1, wherein the actuator is located adjacent a side wall of the body.

12. The fitness bottle of claim 11, wherein the actuator is located below the spout of the closure assembly.

13. The fitness bottle of claim 1, wherein the movement of the actuator in the inward direction is a horizontal movement.

14. The fitness bottle of claim 1, wherein the closure of the closure assembly is mounted for movement relative to the spout of the closure assembly, and the spout of the closure assembly is stationary.

15. The fitness bottle of claim 1, wherein the closure of the closure assembly includes a hood.

16. A closure assembly operable by one hand of a user, the closure assembly being configured for coupling to a body adapted to contain liquid to form a fitness bottle for use during exercise, the closure assembly having:

an open configuration configured to allow liquid to flow through the closure assembly and a closed configuration configured to restrict flow of liquid through the closure assembly; a spout defining an opening through which liquid can flow when the closure assembly is in the open configuration;

a closure configured to seal the opening of the spout when the closure assembly is in the closed configuration and to unseal the opening of the spout when the closure is in the open configuration, wherein the position of the closure relative to the spout changes upon movement of the closure assembly from the open configuration to the closed configuration;

an actuator associated with the closure assembly and positioned for opening actuation by the user to move the closure assembly from the closed configuration to the open configuration and for closing actuation by the user to move the closure assembly from the open configuration to the closed configuration; and a linkage extending between the actuator and the closure assembly, the linkage being configured to translate the opening actuation of the actuator to move the closure assembly from the closed configuration to the open configuration to unseal the opening of the spout of the closure assembly by the closure of the closure assembly, and the linkage also being configured to translate the closing actuation of the actuator to move the closure assembly from the open configuration to the closed configuration to seal the opening of the spout of the closure assembly by the closure of the closure assembly;

wherein the linkage is configured to move toward a top of the fitness bottle in a vertical movement.

17. The closure assembly of claim 16, further comprising a tongue-shaped extension depending downward therefrom, wherein the extension carries the actuator.

18. The closure assembly of claim 17, wherein the tongue-shaped extension is configured and arranged such that the actuator of the closure assembly is spaced from the closure of the closure assembly such that, when coupled to the body, the actuator is spaced below the top of the body.

* * * * *